US010272397B2

(12) United States Patent
Reuter

(10) Patent No.: US 10,272,397 B2
(45) Date of Patent: Apr. 30, 2019

(54) APPARATUS AND METHOD FOR MIXING

(71) Applicant: Marco Systemanalyse und Entwicklung GmbH, Dachau (DE)

(72) Inventor: Martin Reuter, Dachau (DE)

(73) Assignee: MARCO SYSTEMANALYSE UND ENTWICKLUNG GMBH, Dachau (DE)

( * ) Notice: Subject to any disclaimer, the term of this patent is extended or adjusted under 35 U.S.C. 154(b) by 140 days.

(21) Appl. No.: 15/364,884

(22) Filed: Nov. 30, 2016

(65) Prior Publication Data

US 2017/0165621 A1 Jun. 15, 2017

(30) Foreign Application Priority Data

Dec. 10, 2015 (DE) ..... 10 2015 121 535

(51) Int. Cl.

| | |
|---|---|
| ***B01F 3/08*** | (2006.01) |
| ***B01F 5/00*** | (2006.01) |
| ***B01F 5/06*** | (2006.01) |
| ***B01F 15/02*** | (2006.01) |
| ***B01F 15/04*** | (2006.01) |

(52) U.S. Cl.

CPC ..... *B01F 5/0085* (2013.01); *B01F 3/0861* (2013.01); *B01F 5/0614* (2013.01); *B01F 5/0615* (2013.01); *B01F 15/024* (2013.01); *B01F 15/026* (2013.01); *B01F 15/0292* (2013.01); *B01F 15/0429* (2013.01); *B01F 15/0479* (2013.01); *B01F 2015/0221* (2013.01); *B01F 2215/006* (2013.01)

(58) Field of Classification Search

CPC ..... B01F 3/0803; B01F 3/0861

USPC ..... 366/179.1, 181.5, 336–341

See application file for complete search history.

(56) References Cited

U.S. PATENT DOCUMENTS

| | | | | |
|---|---|---|---|---|
| 4,475,821 | A * | 10/1984 | Koch | B01D 15/166 138/38 |
| 6,691,932 | B1 | 2/2004 | Schultz et al. | |
| 7,374,332 | B2 * | 5/2008 | Higashino | B01F 13/0062 137/602 |
| 9,751,060 | B2 | 9/2017 | Lutz et al. | |
| 2015/0165403 | A1 | 6/2015 | Lutz et al. | |

FOREIGN PATENT DOCUMENTS

| | | | |
|---|---|---|---|
| DE | 2642889 | A1 | 3/1978 |
| DE | 2651433 | A1 | 5/1978 |
| DE | 29606710 | A1 | 8/1996 |
| DE | 102012010544 | A1 | 12/2013 |
| JP | H04305240 | A | 10/1992 |

(Continued)

OTHER PUBLICATIONS

German Search Report for German Application No. 102015121535.7 dated Sep. 1, 2016, 9 pages.

(Continued)

*Primary Examiner* — David L Sorkin

(74) *Attorney, Agent, or Firm* — Cantor Colburn LLP

(57) ABSTRACT

In a method for mixing two liquid components of a medium with the aid of a static mixer, the two components are supplied to the static mixer, are mixed therein and are subsequently dispensed from the mixer. In this respect, only one respective component is supplied to the mixer, while the other component is not supplied to the mixer.

10 Claims, 5 Drawing Sheets

(56) References Cited

FOREIGN PATENT DOCUMENTS

Figure 1:
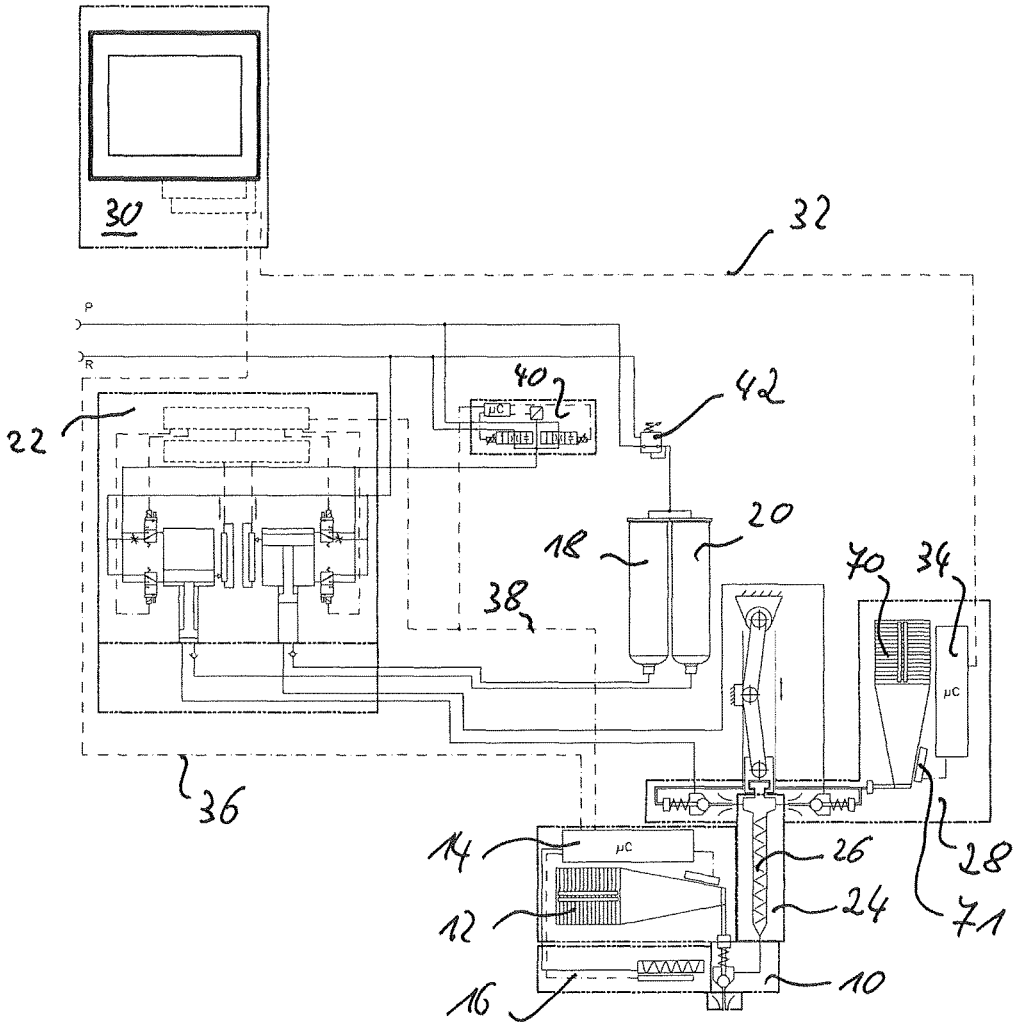

| | | | |
|---|---|---|---|
| JP | H0683741 | A | 3/1994 |
| JP | H06210150 | A | 8/1994 |
| JP | H06210227 | A | 8/1994 |
| JP | 2004154639 | A | 6/2004 |
| JP | 20077275844 | A | 10/2007 |
| JP | 2010247348 | A | 11/2010 |
| JP | 2015525117 | A | 9/2015 |
| WO | 2006039827 | A1 | 4/2006 |

OTHER PUBLICATIONS

Communication from the Patent Office in Korea for related KR Application No. 10-2016-0168688; dated Mar. 13, 2018; 8 pages.
Japanese Office Action from the Japanese Patent Office for related Japanese Application No. 2016-228466 dated Oct. 24, 2017; 6 pages.

* cited by examiner

APPARATUS AND METHOD FOR MIXING

The present invention relates to methods and to apparatus for mixing two liquid components of a medium.

Two-component adhesives are typically produced in that two liquid components are discharged from separate reservoirs, are mixed with one another and are subsequently brought to an adhesion point. It is known for the mixing of the two components to use a static mixer to which the two components are supplied, with the two components being blended with one another by the static mixer during the transport.

An application of two-component adhesives by jetting, i.e. by discharging the mixed medium in the form of very small droplets which fly freely through the air, is, however, not possible to date. With known metering apparatus, the static mixer is located directly in front of a discharge nozzle, with the mixer working at a low pressure and ending unpressurized at the nozzle.

It is therefore the object of the invention to provide methods and apparatus with which two liquid components of a medium can be mixed such that a discharge of the mixed medium in droplet form by jetting is possible.

This object is satisfied by the features of the independent claims.

In accordance with a first aspect of the invention, the object is satisfied by a method for mixing two liquid components of a medium with the aid of a static mixer, wherein the two components are supplied to the static mixer, are mixed therein and are subsequently dispensed from the mixer, with only one respective component being supplied to the mixer, while the other component is not supplied to the mixer, and vice versa. In other words, the two components are never added into the mixer simultaneously, but either the one component or the other component is conveyed into the mixer. In this manner, the mixing ratio can be set as desired by the volume of the one or of the other component supplied per time unit. At the same time, a very exact metering of the two alternately supplied components can be achieved by supplying only one respective component at a time.

Advantageous embodiments of the invention are described in the description, in the drawing and in the dependent claims.

In accordance with an advantageous embodiment, the components can be supplied to the mixer in cycles, whereby a very precise metering is possible.

It can furthermore be advantageous if droplets of the same size are dispensed from the mixer in consecutive cycles after the mixing, with the mixing ratio of the two components being set by the number of cycles during which the respective component is supplied to the mixer. For a mixing ratio of 1:1, for example, the one component and the other component can thus always be supplied alternately during consecutive cycles. For a mixing ratio of 1:10, for example, only the one component can be supplied during a first cycle and subsequently only the other component during ten consecutive cycles. The respective desired mixing ratio thus arises by an alternate input of the two components into the mixer, with one component being introduced into the mixer multiple times in consecutive cycles.

It can be advantageous for a precise metering and a good intermixing if each component is pumped into the mixer via its own pump device, with the two pump devices being controlled independently of one another. The pressure at which each component is introduced into the mixer can hereby be set to a desired value separately for each component so that both components are available at a desired pressure at the inlet of the mixer.

In accordance with a further advantageous embodiment, the mixed medium is dispensed from the mixer in droplets of equal size through a metering valve, with the valve being operated at a frequency of more than 50 Hz, in particular of more than 100 Hz, at least in specific periods of time or time intervals. Not only points, but also lines or areas can be provided with adhesive by jetting in this manner in a very short time.

In accordance with a further advantageous embodiment, the two components are supplied to the mixer via a single mixing valve. It can hereby be ensured that the two components are never introduced into the mixer simultaneously, but rather only alternately or in turn. In accordance with a further advantageous embodiment, the mixing valve can be synchronized with the metering valve so that exactly one unit of a component is introduced into the mixer during each droplet dispensing. It can be ensured by an adjustable phase shift that exactly one unit of a component is supplied into the mixer in each case during a droplet dispensing or between two consecutive droplet dispensing procedures even in switching procedures which incur delays.

The desired mixing ratio can be set particularly finely in that changing sequences having different mixing ratios are introduced into the mixer after one another, for example in a ratio of consecutively 1:10; 1:11; 1:10; etc.

A change of the droplet size of the dispensed mixed medium can take place in an advantageous manner in that the droplet size is set by changing the pressure at which the two components are introduced into the mixer. It can hereby be advantageous if the two components are introduced into the mixer at a comparatively high pressure of, for example, more than 20 bar or also more than 40 bar.

If the volume of the component portions supplied to the mixer is additionally determined, the mixing ratio and the droplet size can be monitored.

In accordance with a further aspect of the present invention, it relates to an apparatus for carrying out the above-described methods comprise a static mixer having a mixing coil in which the two components are mixed, with a mixing valve being provided with which the two components can only be alternately introduced into the mixer.

Since, as described above, the introduction of the two components into the static mixer at a high pressure is of advantage, it can be advantageous if the static mixer comprises a mixing coil which is releasably inserted into a pressure housing. It is ensured in this manner that the housing surrounding the mixing coil withstands the pressure occurring in the mixer. A removability of the mixing coil from the pressure housing is provided for a multiple use of the pressure housing so that the mixing coil can be removed after the end of a working process before the adhesive has hardened.

It can be advantageous in this connection if a quick-release device is provided with which the mixing coil can be abruptly removed from the mixer. Adhesives with extremely brief pot lives can hereby also be processed.

In accordance with a further advantageous embodiment, a separate pump device is provided for each component to pump the respective component out of a tank into the mixer, with each pump device comprising a pneumatically driven pump piston and a check valve. Using two separate pump devices, the total apparatus can be operated in an automated manner and can also be operated such that no unwanted pressure increases occur in metering breaks.

It can furthermore be advantageous if a tank is provided for each component, with at least one tank being able to be acted on by an adjustable compressed air regulator. The respective component can hereby already be introduced into the pump device at pressure.

In accordance with a further aspect of the invention, it relates to a mixing valve for carrying out the above-described methods or for use in an apparatus of the above-described type, with the mixing valve comprising a valve drive as well as a first and a second component supply having a respective valve needle and a valve seat. The two valve needles are alternately set against their associated valve seat by the valve drive, whereby it is provided that a respective only one component of the medium is introduced into the mixer at one time.

In accordance with an advantageous embodiment, a yoke can be provided between the valve drive and the valve needles, said yoke pressing alternately onto the one or the other valve needle by a tilt movement.

It can furthermore be advantageous if a distance measuring device is integrated into the valve for the monitoring of the switch position since in this case an automated control having high precision is possible.

Figure 2:
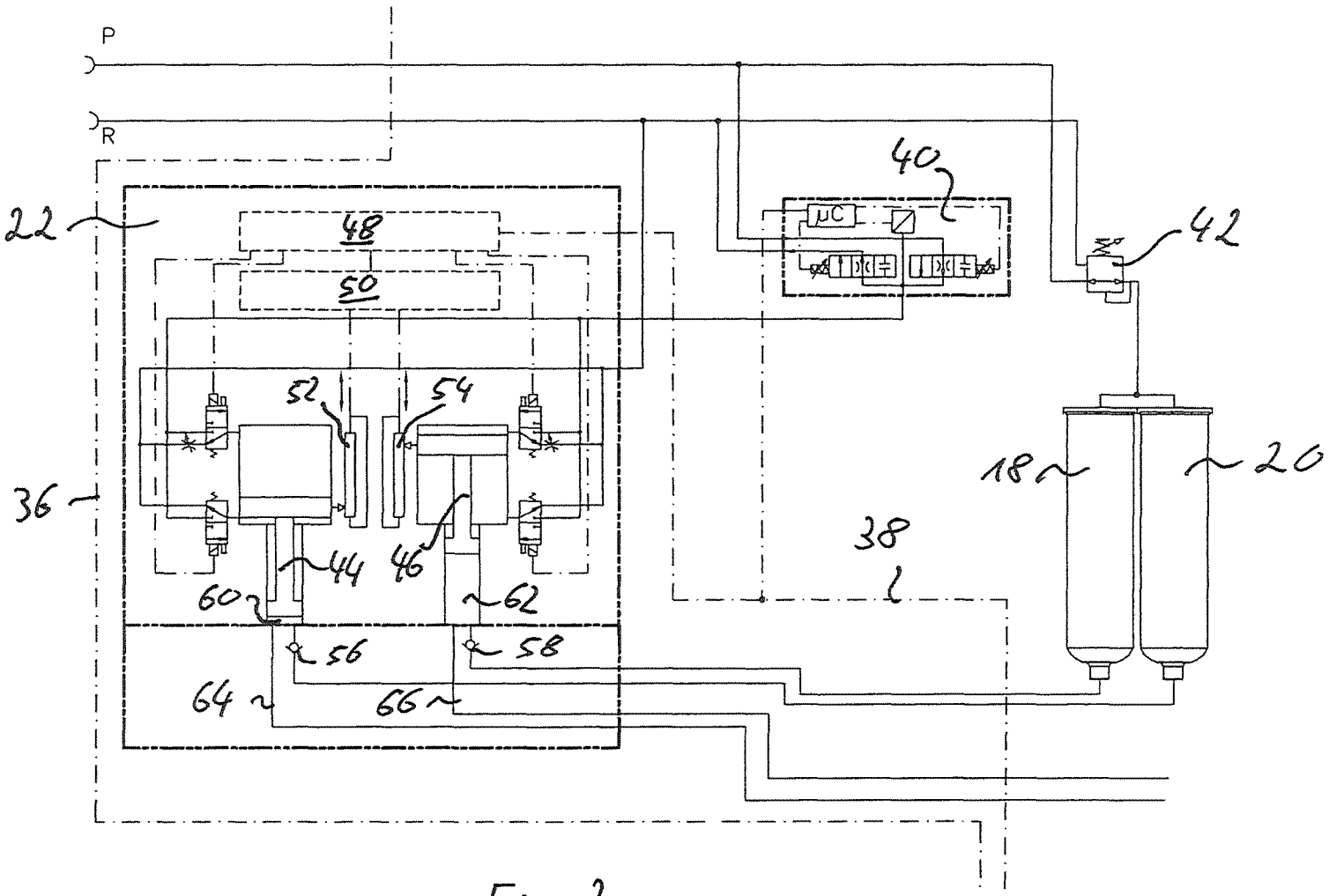
Figure 3:
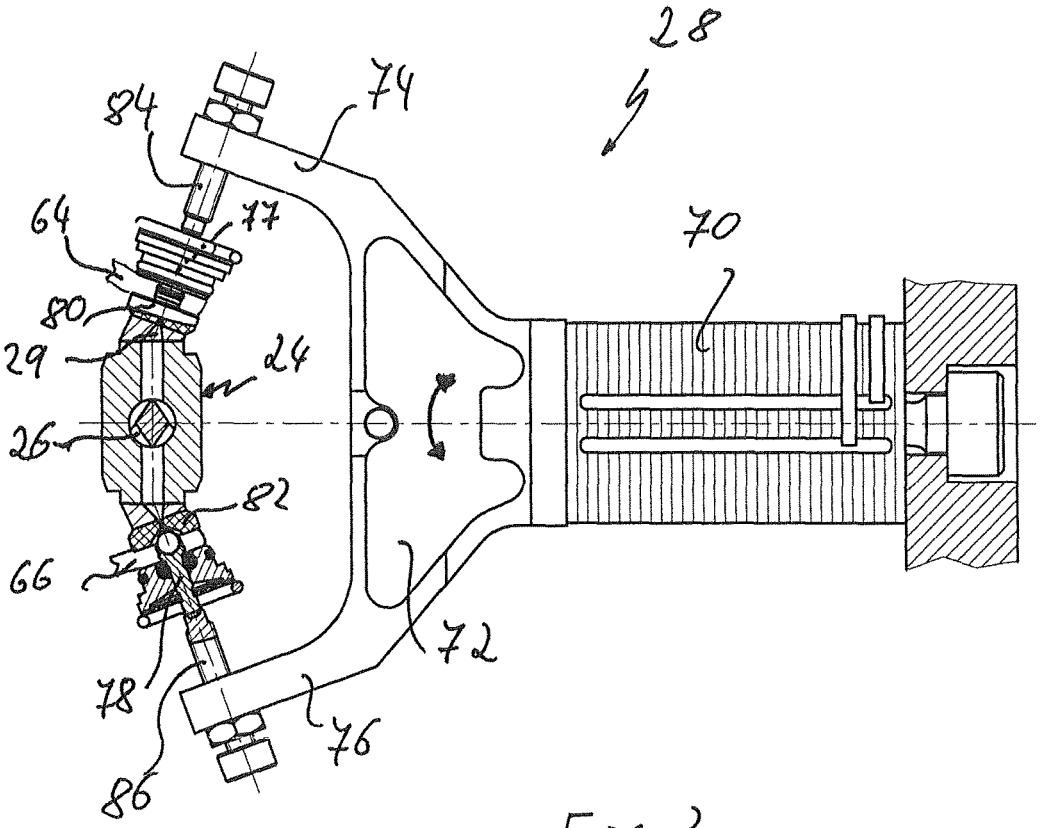
Figure 4:
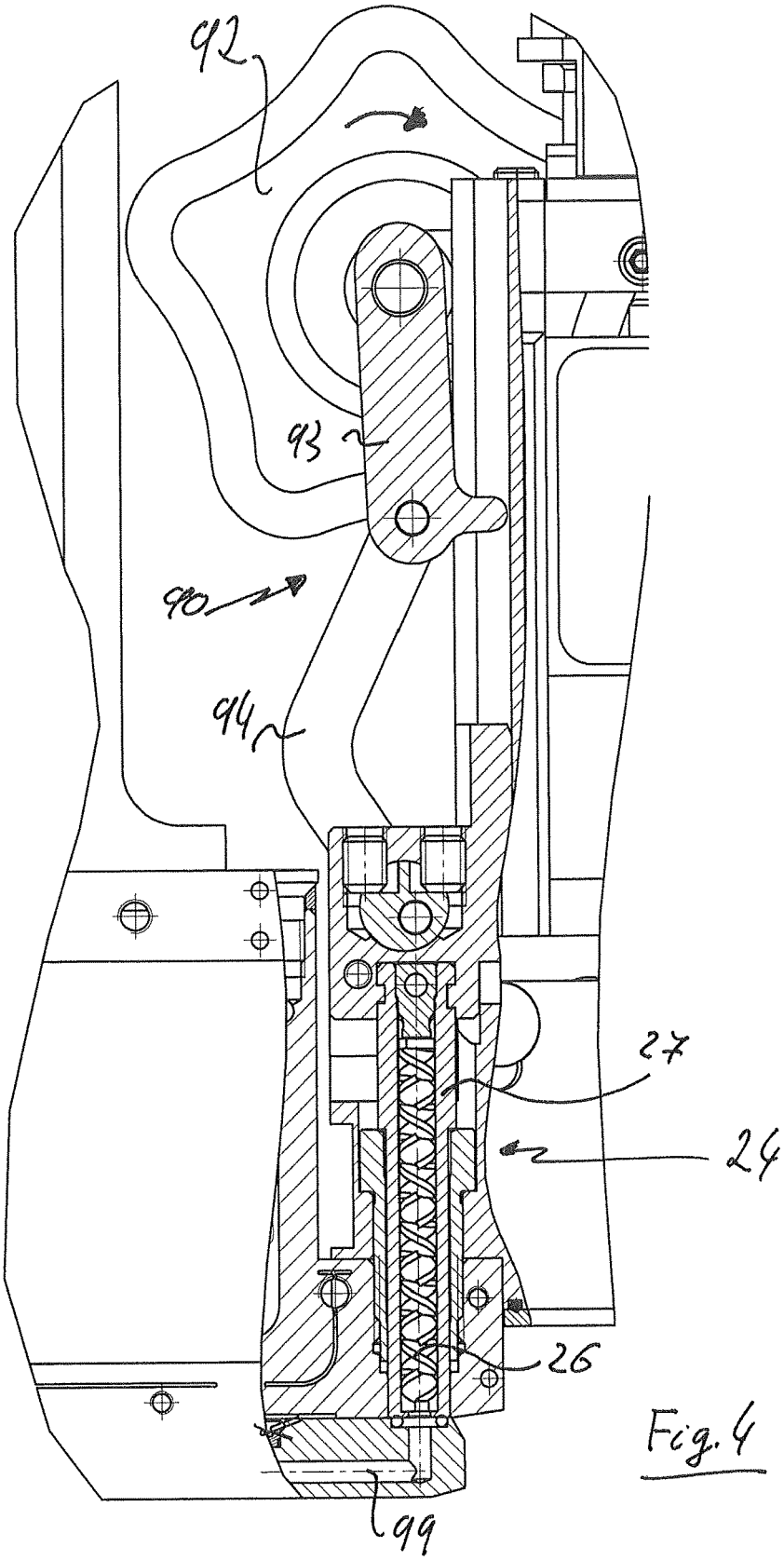

The present invention will be described in the following purely by way of example with reference to an advantageous embodiment and to the enclosed drawings. There are shown:

FIG. 1 a schematic representation of a metering apparatus;

FIG. 2 a part enlargement of FIG. 1;

FIG. 3 a partly sectional view of a mixing valve;

FIG. 4 a partly sectional view of a mixing apparatus; and

Figure 5:
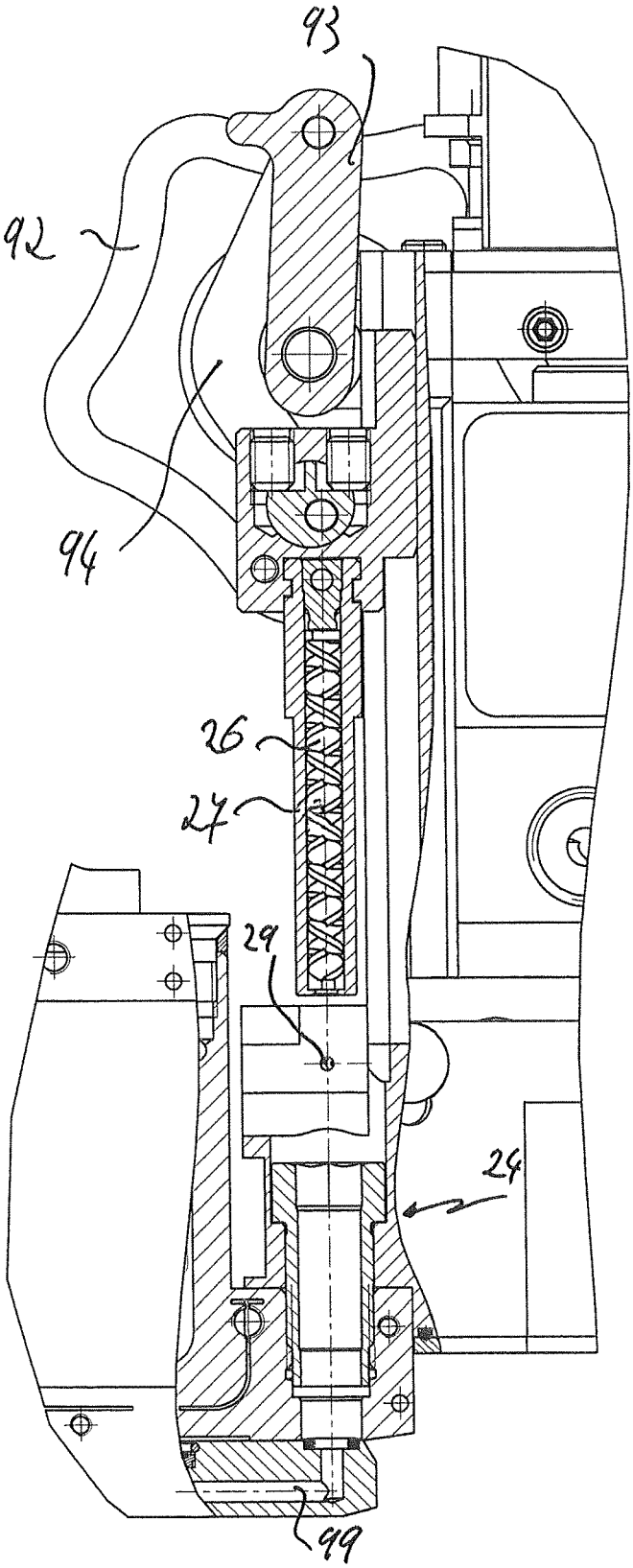

FIG. 5 a view of the mixing apparatus of FIG. 4 with a removed mixing coil.

The metering apparatus shown schematically in FIG. 1 comprises a metering valve 10 through which two-component adhesive can be jetted in droplet form. For this purpose, the metering valve 10 can be controlled at radio frequency via a valve drive 12 which is controlled by a control 14. Reference numeral 16 designates a device for the temperature control of the valve.

The two components of the medium to be mixed are located in two separate reservoirs 18 and 20 and are conveyed from there into a pump device 22 from where the two components are separately supplied to a static mixer 24 having a mixing coil 26. In this respect, a mixing valve 28 is provided for the separate supply of the two components through which only a respective one component is supplied to the mixer 24, while the other component is not supplied to the mixer, and vice versa. In other words, the two components are introduced alternately into the mixer 24, but never simultaneously.

A control processor 30 is provided for controlling the metering apparatus and is connected via a control line 32 to a microcontroller 34 of the mixing valve 28. The control processor 30 is furthermore connected to the microcontroller 14 of the metering valve 10 via a synchronization line. Finally, the control processor 30 is also connected via a further control line 38 to a microcontroller of a pressure regulator 40 which regulates the pump pressure for the pump device 22.

The described pump apparatus has two pneumatic connectors P and R which are both connected to the pressure regulator 40 and to an adjustable pressure regulation valve 42 via which the two reservoirs 18 and 20 are pressurized by, for example, approximately 2 to 3 bar to introduce the component contained in the respective reservoir into the pump device 2.

The pump device 22 will be described in more detail in the following with reference to FIG. 2.

Two pump pistons 44 and 46 are provided separately for each component in the pump device 22 and can have compressed air applied to them via pneumatic valves such that they carry out consecutive pump strokes. The control of the two pump pistons 44 and 46 takes place independently of one another by a control 48. Further control electronics 50 are connected to sensors 52 and 54 which detect the respective pump stroke of a pump piston, whereby a path measurement of the pump stroke is possible and thus the volume of the pumped component can be determined.

As FIG. 2 illustrates, the two reservoirs 18 and 20 are connected via a respective line and via a check valve 56 and 58 respectively to a pump space 60 or 62 respectively into which the respective pump piston 44 and 46 respectively is moved to and fro. Each component can first be introduced in this manner separately from the other from the reservoir 18 or 20 into the pump space 60 or 62 and can be pumped from there via discharge lines 64 and 66 to the mixing valve 28 (FIG. 1).

The mixing valve 28 will be described in more detail in the following with reference to FIG. 3.

FIG. 3 shows a partly sectional view of the mixing valve 28 which is provided with a drive 70 in the form of a piezoelectric torque block of the applicant. Two piezoelectric stacks are integrated into this drive and the drive can carry out a tilt movement about the center of gravity of the drive 70 in the direction of the double arrow with their aid.

The valve drive 70 is connected to a yoke 72 whose two arms 74 and 76 act on a respective valve needle 77 and 78 which closes a valve seat 80, 82 via a valve ball connected thereto. The two valve needles 77 and 78 are each connected via adjustable plungers 84, 86 to the arms 74, 76 of the yoke 72 to set the opening stroke exactly. The supply lines 64 and 66 coming from the pump device open into the region of the respective valve seat 80, 82 so that the respective component is applied at pressure at the respective valve seat 80, 82. By actuating the valve drive 70, the yoke 72 carries out an alternating pivot movement in the direction of the double arrow, whereby the two valve seats 80 and 82 are alternately opened and closed in that the valve needles 77, 78 are alternately set against their associated valve seat 80, 82. On each opening stroke of the mixing valve, the valve needle is pressed with the valve ball fastened thereto into its open position by a spring. The two components are hereby introduced into the static mixer 24 and are mixed therein by the mixing coil 26. Only one respective component is, however, supplied to the mixer 24, while the other component is not supplied to the mixer or the other component is supplied to the mixer, while the one component is not supplied to the mixer.

As FIG. 1 illustrates, the mixing valve 28 is also provided with a distance measuring device 71 by which the respective switch position of the valve can be monitored.

FIG. 4 shows an enlarged and partly sectional representation of the static mixer 24 whose mixing coil 26 is surrounded by a pressure housing 27. The mixing coil 26 can be abruptly removed together with the pressure housing 27 from the static mixer 24 via a quick-release device 90, as is illustrated in FIG. 5. For this purpose, the quick-release device has a handwheel 92 which is connected via a toggle lever 93, 94 to the mixing coil 26 and to the pressure housing 27. The mixing coil 26 can thus be abruptly pulled out of the static mixer 24 together with the pressure housing 27 by rotating the handwheel 92 in the direction of the arrow shown in FIG. 4. In this position shown in FIG. 5, the supply passage 29 can also be recognized (cf. also FIG. 3) via which a component is supplied—controlled via the mixing valve 28. At the same time, FIGS. 4 and 5 also show a discharge passage 99 via which the medium comprising the two mixed components is supplied to the metering valve 10.

The two components of the medium to be mixed is conveyed separately by the above-described mixing and metering apparatus. These pumps are each equipped with a measuring system 50, 52, 54 with whose aid the mixing ratio and the quantity removed from the respective reservoir can be determined. The pumps receive the pressurized medium in the reservoirs 18 and 20 and press it in the direction of the mixing valve 28 at approximately 20 to 60 bar. This valve is designed such that only one component can always be introduced into the mixer 24, while the valve for the other component is closed. The correct mixing ratio arises by an alternate input into the mixer. Since the quantities which are to be metered by individual droplets (dots) during jetting are extraordinarily small, a high-resolution volume measurement or a quantity measurement is only possible before the mixer with a great effort. In accordance with the invention, the volume of each component is therefore measured at the dispensed dots since the mixing valve only allows one respective component to flow in. The viscosity of the mixed product at the outlet of the mixer 24 is constant, i.e. the quantity of the dispensed dots is of an equal amount.

Since a metering of the desired application structure (larger points, lines or areas) requires a large number of points in a short time, metering frequencies of more than 100 Hz are provided. In order to directly supply small quantities of the individual components in the desired mixing ratio, the mixing valve is switched over reliably and fast between two dispensed dots. It results from this that the mixing valve 28 has to switch over extremely fast and must reliably stop the one component when the other is released. The mixing ratio results by the number of dots, during which either the one component or the other component is supplied to the mixer.

In the apparatus in accordance with the invention, the possible continuous mixing volume is bounded in a simple design with only two pump pistons by the stroke volume of the pump piston. However, unlimited lines can also be drawn with this arrangement since the robot by which the valve is moved can also stop in coordinated work with the metering head or can reduce to a low travel speed when the pump has to reload.

Since the adhesives to be processed have comparatively short pot times of approximately 2 to 20 min, provision is made in the apparatus in accordance with the invention that metering automatically takes place into a waste disposal container on an interruption of the work procedure. At the end of work, one component is first conveyed alone through the mixer and the metering valve. The mixing coil can subsequently be abruptly drawn out of the mixer via the quick-release mechanism 90.

Since the mechanical mount of the pressure housing 27 in the quick-release device 90 is of an asymmetrical design, the mixing coil cannot be inserted incorrectly. Since, furthermore, in accordance with the invention, the supply into the mixing coil is designed such that the component having the smaller portion can be mixed directly into the larger component, an insertion of the mixing coil secure against rotation is likewise of significance.

The invention claimed is:

1. A method for mixing two liquid components of a medium with the aid of a static mixer, wherein the two liquid components are supplied to the static mixer, are mixed therein and are subsequently dispensed from the static mixer as a medium, wherein only one of the two liquid components is supplied to the static mixer, while the other of the two liquid components is not supplied to the static mixer, and vice versa, the two liquid components being supplied to the static mixer in a cycled manner, the medium being dispensed in the form of droplets having the same size, with the droplets being dispensed from the static mixer in consecutive cycles after the mixing, and wherein a mixing ratio of the two liquid components is set by a number of cycles during which the respective liquid component is supplied to the static mixer.

2. The method in accordance with claim 1, wherein each of the two liquid components is pumped into the static mixer via its own pump device, with the two own pump devices being controlled independently of one another.

3. The method in accordance with claim 1, wherein the mixed medium is dispensed out of the static mixer in droplets of equal size through a metering valve which is operated at a frequency of more than 50 Hz, at least in specific time intervals.

4. The method in accordance with claim 1, wherein the two liquid components are supplied to the static mixer via a single mixing valve.

5. The method in accordance with the claim 4, wherein the mixed medium is dispensed out of the static mixer in droplets of equal size through a metering valve which is operated at a frequency of more than 50 Hz, at least in specific time intervals; and wherein the metering valve and the mixing valve are synchronized.

6. The method in accordance with claim 5, wherein the metering valve and the mixing valve are synchronized with an adjustable phase shift.

7. The method in accordance with claim 5, wherein the mixing valve is actuated between two opening strokes of the metering valve.

8. The method in accordance with claim 1, wherein the medium is dispensed out of the static mixer in droplet form; and wherein the droplet size is set by changing the pressure at which the two liquid components are introduced into the static mixer.

9. The method in accordance with claim 1, wherein the pressure at which the two liquid components are introduced into the static mixer is selected as larger than 20 bar.

10. The method in accordance with claim 1, wherein a volume of the two liquid components supplied to the static mixer is determined.

* * * * *